US006482528B2

(12) United States Patent
Anada et al.

(10) Patent No.: US 6,482,528 B2
(45) Date of Patent: Nov. 19, 2002

(54) NICKEL-BASE ALLOY PRODUCT AND METHOD OF PRODUCING THE SAME

(75) Inventors: Hiroyuki Anada, Nishinomiya (JP); Kazuyuki Kitamura, Kobe (JP); Toshihiro Imoto, Kobe (JP); Osamu Miyahara, Amagasaki (JP)

(73) Assignee: Sumitomo Metal Industries, Inc., Osaka (JP)

( * ) Notice: Subject to any disclaimer, the term of this patent is extended or adjusted under 35 U.S.C. 154(b) by 0 days.

(21) Appl. No.: 10/119,085

(22) Filed: Apr. 10, 2002

(65) Prior Publication Data

US 2002/0155306 A1 Oct. 24, 2002

Related U.S. Application Data

(63) Continuation of application No. PCT/JP01/06647, filed on Aug. 1, 2001.

(30) Foreign Application Priority Data

Aug. 11, 2000 (JP) ..... 2000-244452
Jul. 19, 2001 (JP) ..... 2001-219742

(51) Int. Cl.[7] ..... C22C 19/05; C22F 1/02; C22F 1/10; B32B 15/04

(52) U.S. Cl. ..... 428/472; 928/472.1; 928/633; 928/680; 148/675; 148/676; 148/427

(58) Field of Search ..... 428/472, 472.1, 428/633, 680; 148/675, 676, 427

(56) References Cited

U.S. PATENT DOCUMENTS 4,602,968 A * 7/1986 Bergmann et al. ..... 138/177
4,820,473 A * 4/1989 Ohashi et al. ..... 148/287
4,828,790 A * 5/1989 Honda et al. ..... 148/287
5,656,099 A * 8/1997 Ohmi ..... 148/280
5,774,516 A * 6/1998 Hettiarachchi et al. ..... 376/305
5,904,991 A * 5/1999 Hettiarachchi ..... 376/305
6,231,690 B1 * 5/2001 Azuma ..... 148/287

FOREIGN PATENT DOCUMENTS

| | | |
|---|---|---|
| EP | 0261880 | 3/1988 |
| JP | 64-055366 | 3/1989 |
| JP | 64-068458 | 3/1989 |
| JP | 01-159362 | 6/1989 |
| JP | 02-047249 | 2/1990 |
| JP | 02-080552 | 3/1990 |
| JP | 02-247358 | 10/1990 |
| JP | 03-153858 | 7/1991 |
| JP | 04-297537 | 10/1992 |

* cited by examiner

*Primary Examiner*—Deborah Jones
*Assistant Examiner*—Jason L. Savage
(74) *Attorney, Agent, or Firm*—Burns, Doane, Swecker & Mathis, LLP

(57) ABSTRACT

(1) A nickel-base alloy product having, on the surface thereof, an oxide film comprising at least two layers, namely a first layer mainly composed of $Cr_2O_3$ and having a chromium content of not less than 50% relative to the total amount of metal elements and a second layer occurring outside the first layer and mainly composed of $MnCr_2O_4$, wherein the grain size of $Cr_2O_3$ crystals in the first layer is 50 to 1,000 nm and the total oxide film thickness is 180 to 1,500 nm.

(2) A method of producing the nickel-base alloy product as specified above under (1) which comprises subjecting a nickel-base alloy product to oxide film formation treatment by maintaining the same at a temperature of 650 to 1,200° C. in a hydrogen atmosphere or hydrogen-argon mixed atmosphere showing a dew point of −60° C. to +20° C. for 1 to 1,200 minutes.

The product mentioned above (1) allows only a very low level of Ni release in a high-temperature water environment over a long period of time and is particularly suited for use as a nuclear reactor member.

10 Claims, 2 Drawing Sheets

NICKEL-BASE ALLOY PRODUCT AND METHOD OF PRODUCING THE SAME

This application is a continuation of International Application No. PCT/JP01/06647 filed on Aug. 1. 2001, which International Application was published by the International Bureau in Japanese on Feb. 21, 2002.

TECHNICAL FIELD

The present invention relates to a nickel-base alloy product, nickel release from which is suppressed in low level even during a long period of use in high temperature water environments, and relates to a method of producing the same. This nickel-base alloy product is suited for use as structural members in nuclear reactors.

BACKGROUND ART

Nickel-base alloys, which have good mechanical properties, have been used as various members. In particular, nickel-base alloys superior in corrosion resistance are used as materials of nuclear reactor members which are exposed to high temperature water. Thus, Alloy 690 (60% Ni-30% Cr-10% Fe, trademark), for instance, is used in steam generators of Pressurized Water Reactors (PWRs).

These are to be used in nuclear reactor water environments, namely, high temperature water environments at about 300° C., for at least several years to a period as long as several decades. Although nickel-base alloys are highly resistant to corrosion and the rate of corrosion thereof is slow, nickel is released from the alloys during a long period of use to form nickel ions, though in very small amounts.

In the process of circulation of reactor water, the released nickel is carried to the reactor core and irradiated with neutrons in the vicinity of the fuel. Upon irradiation with neutrons, nickel is converted to cobalt as a result of a nuclear reaction. Having a very long half-life, the cobalt continues to emit radiations for a long period of time. Therefore, if nickel is released in large amounts, workers engaged in periodic inspection, for instance, may be exposed to increased radiation doses.

To reduce the exposure dose is very important in using light water reactors for a long period of time. Therefore, in the art, measures have been taken to prevent the release of nickel from nickel-base alloys by improving the corrosion resistance on the material side or controlling the quality of nuclear reactor water.

JP Kokai S64-55366 discloses a method of improving the resistance to uniform corrosion of nickel-base alloy heating tubes. The method comprises annealing the tubes in a temperature range of 400–750° C. in a high vacuum atmosphere of $10^{-2}$ to $10^{-4}$ torr in order to form an oxide film mainly composed of chromium oxides. JP Kokai H01-159362 discloses a method of improving the resistance to intergranular stress corrosion cracking by heat treatment in a temperature range of 400–750° C. in an inert gas containing $10^{-2}$ to $10^{-4}$ volume % of oxygen to cause formation of an oxide film mainly composed of chromium oxide ($Cr_2O_3$).

JP Kokai H02-47249 and JP Kokai H02-80552 disclose methods of preventing the release of Ni and Co from stainless steel for heater tubes by heating the steel in an inert gas containing a specified amount of oxygen to cause formation of a chromium oxide film.

JP Kokai H03-153858 discloses a stainless steel resistant to the release in high-temperature water as a result of having, on the surface thereof, an oxide layer containing chromium-containing oxides in a higher proportion as compared with non-chromium-containing oxides.

The methods mentioned above all attempt to reduce the level of the release of metals by forming an oxide film mainly composed of $Cr_2O_3$ by heat treatment. However, the $Cr_2O_3$ film obtained by those methods loses their release preventing effect as a result of damage, for instance, during a long period of use. This is presumably due to an insufficient film thickness, an inadequate film structure, and low chromium content in the film.

DISCLOSURE OF INVENTION

It is an object of the present invention to provide a nickel-base alloy product showing a very low level of nickel release in high-temperature water environments over a long period of time, and a method of producing the same.

The gist of the present invention consists in a nickel-based alloy product as defined below under (1) and a method of producing the same as defined below under (2). In the following description, the percent value (%) expressing the content of each component means "% by mass", unless otherwise specified.

(1) A nickel-base alloy product having, on the surface thereof, an oxide film comprising at least two layers, namely a first layer mainly composed of $Cr_2O_3$ and having a chromium content of not less than 50% relative to the total amount of metal elements and a second layer occurring outside the first layer and mainly composed of $MnCr_2O_4$, wherein the grain size of $Cr_2O_3$ crystals in the first layer is 50 to 1,000 nm and the total oxide film thickness is 180 to 1,500 nm.

(2) A method of producing the nickel-base alloy product as specified above under (1) which comprises subjecting a nickel-base alloy product to oxide film formation treatment by maintaining the same at a temperature of 650 to 1,200° C. in a hydrogen atmosphere or hydrogen-argon mixed atmosphere showing a dew point of −60° C. to +20° C. for 1 to 1,200 minutes.

It is desirable that the nickel-base alloy to serve as the base metal for producing the above product (1) is a nickel-base alloy containing C: 0.01–0.15%, Mn: 0.1–1.0%, Cr: 10–40%, Fe: 5–15% and Ti: 0.1–0.5%, with the balance being nickel and impurities.

In the above production method (2), the oxide film formation treatment mentioned above may be followed by further heat treatment by maintaining the product at 650–750° C. for 300 to 1,200 minutes. Prior to oxide film formation treatment, the product may also be subjected to cold working. Cold working is effective in modifying the condition of the surface of the nickel-base alloy product in a manner such that chromium can diffuse more easily on the surface and in promoting the oxide film formation in the subsequent oxide film formation treatment.

In the present specification, the term "nickel-base alloy product" includes, within the meaning thereof, various products made of a nickel-base alloy, such as tubes or pipes, sheets or plates, rods or bars, and containers formed therefrom. The surface of a nickel-base alloy product means part or the whole of the surface of the product. When the product is a steam generator tube, for instance, the oxide film may be formed only on the inside surface of the product.

The grain size of $Cr_2O_3$ crystals in the first layer mainly composed of $Cr_2O_3$ is determined in the following manner. The nickel-base alloy product is dissolved in bromine-methanol solution, for instance, and three fields of the base metal side of the remaining oxide film is observed under Field Emission Electron Gun-Scanning Electron Microscope (FE-SEM) at a magnification of 20,000. The mean of the minor axis and major axis for each crystal is regarded as the grain size thereof. The average of such mean values is the crystal grain size.

BEST MODES FOR CARRYING OUT THE INVENTION

1. Nickel-base alloy constituting the product of the invention

The base metal for the nickel-base alloy product of the invention is an alloy whose major component is nickel. In particular, an alloy containing 0.01–0.15% of C, 0.1–1.0% of Mn, 10–40% of Cr, 5–15% of Fe and 0.1–0.5% of Ti with the balance being Ni and impurities is desirable. The reasons are as follows.

Cr is an element necessary for the formation of an oxide film capable of preventing release of metals. For forming such oxide film, it is necessary that the alloy contains not less than 10% of Cr. When, however, its content exceeds 40%, the Ni content becomes relatively low, hence the corrosion resistance of the alloy decreases.

Fe is an element capable of forming a solid solution in nickel and therefore can be used partly in lieu of nickel, which is expensive. However, at a content level higher than 15%, the corrosion resistance of the nickel-base alloy is impaired.

C is desirably contained at a level not lower than 0.01% in order to increase grain boundary strength. On the other hand, its level is preferably not higher than 0.15% so that good stress corrosion cracking resistance can be obtained. Alevel of 0.01–0.06% is more preferable.

Mn is desirably contained in an amount of not less than 0.1% for the formation of the second layer mainly composed of $MnCr_2O_4$. A level exceeding 1.0%, however, reduces the corrosion resistance of the alloy.

Ti is desirably contained in an amount of not less than 0.1% so that the workability of the alloy can be improved. A level exceeding 0.5%, however, impairs the cleanliness of the alloy.

The remainder other than the above components is substantially accounted for by nickel. For obtaining a nickel-base alloy having good corrosion resistance, a Ni content of 45–75% is preferred. As for the impurities, it is desirably that Si be not more than 0.5%, Cu not more than 0.50%, S not more than 0.015%, and P not more than 0.030%.

The following two species are typical of the nickel-base alloy mentioned above.

(1) An alloy comprising C: not more than 0.15%, Si: not more than 0.50%, Mn: not more than 1.00%, P: not more than 0.030%, S: not more than 0.015%, Cr: 14.00–17.00%, Fe: 6.00–10.00%, Cu: not more than 0.50%, and Ni: not less than 72.00%;

(2) An alloy comprising C: not more than 0.05%, Si: not more than 0.50%, Mn: not more than 0.50%, P: not more than 0.030%, S: not more than 0.015%, Cr: 27.00–31.00%, Fe: 7.00–11.00%, Cu: not more than 0.50%, and Ni: not less than 58.00%.

2. Oxide film (1) Structure of the oxide film

Figure 1:
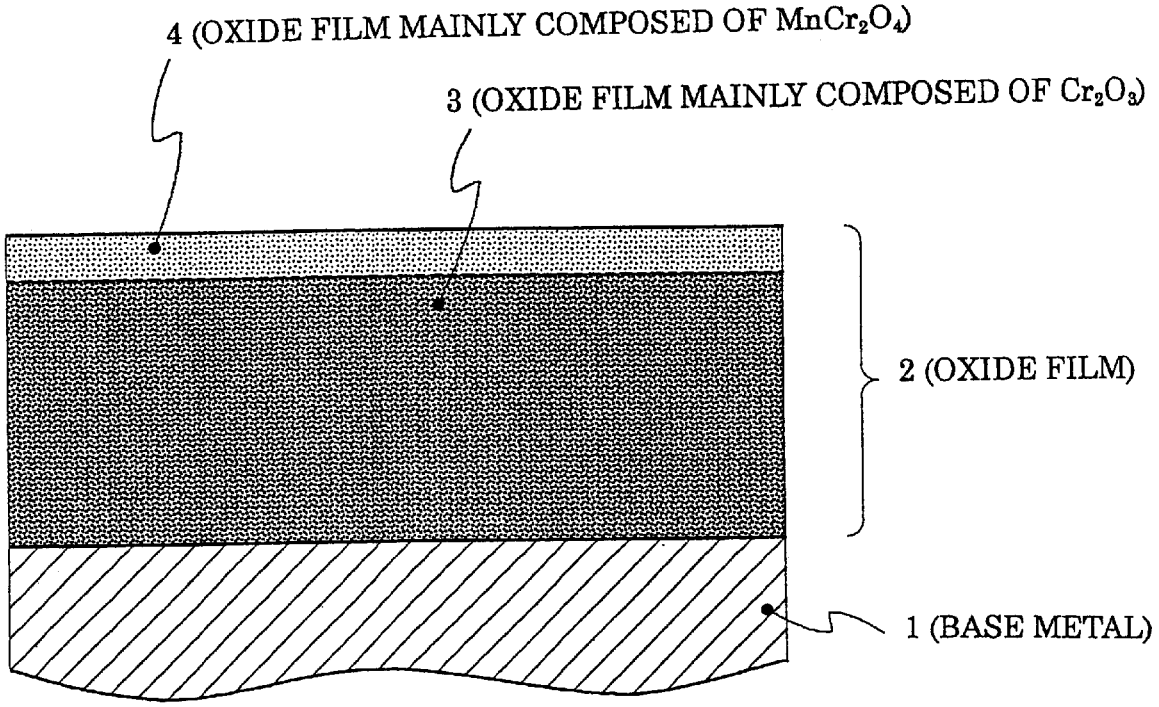
FIG. 1 is a schematic representation of the sectional view, in the vicinity of the surface, of the nickel-base alloy product of the present invention.

FIG. 1 is a schematic representation of the sectional view, in the vicinity of the surface, of the nickel-base alloy product of the present invention. As shown, an oxide film 2 is present on the surface of the nickel-base alloy product. The sectional structure thereof comprises, from the side near to the base metal 1 and as roughly divided, a first layer 3 mainly composed of $Cr_2O_3$ and a second layer 4 covering the first layer and mainly composed of $MnCr_2O_4$.

Figure 2:
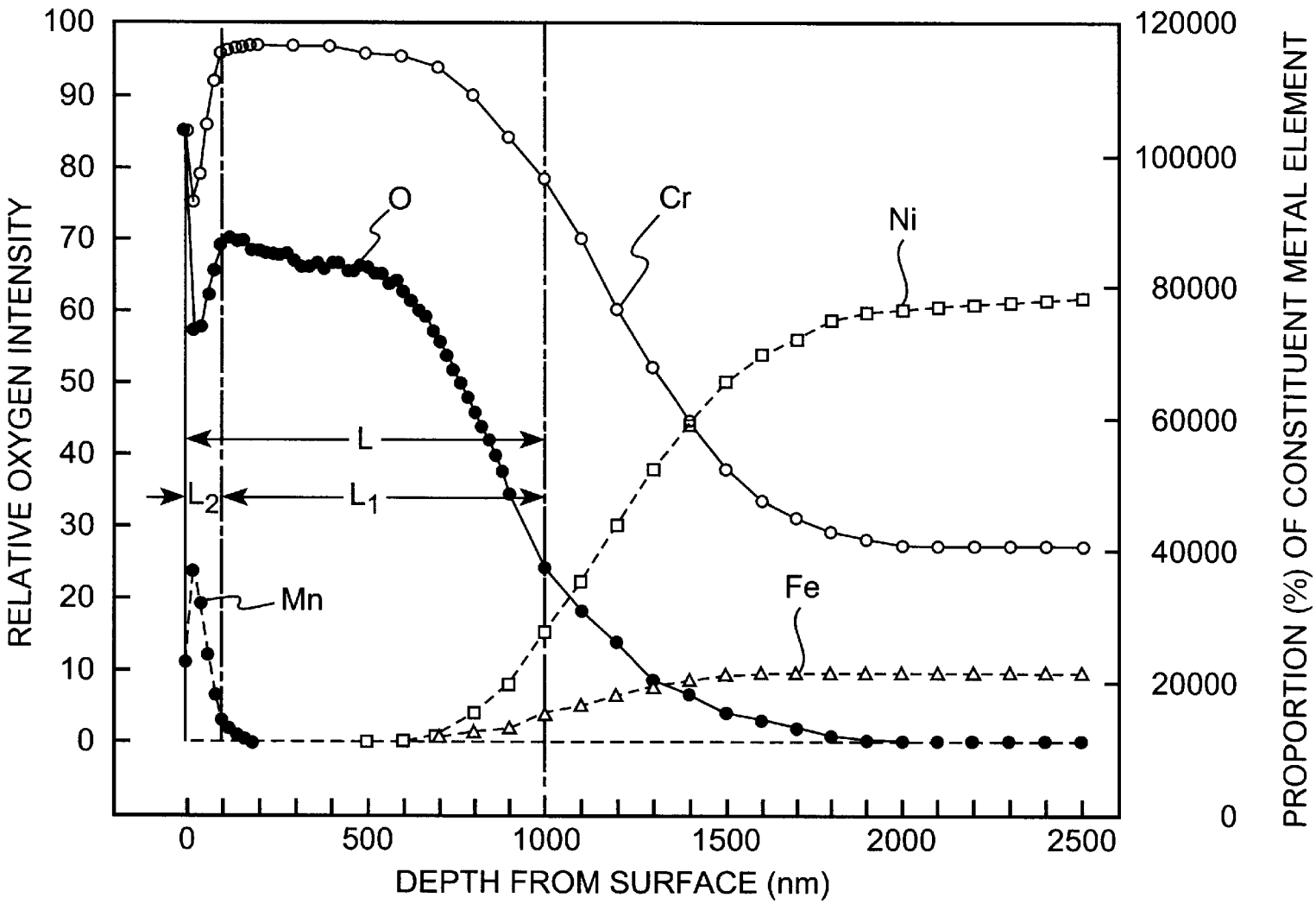
FIG. 2 is a representation of the results of SIMS analysis of a nickel-base alloy having an oxide film on the surface.

FIG. 2 shows the results of analysis with Secondary Ion Mass Spectrometry (SIMS) of a sample derived from an alloy containing 29.3% Cr and 9.7% Fe, with the balance being Ni, by causing formation of an oxide film on the surface thereof. In this figure, the portion showing a higher proportion of Cr indicates the first layer mainly composed of $Cr_2O_3$, and the outermost layer showing a higher proportion of Mn is the second layer mainly composed of $MnCr_2O_4$. These layers contain oxides of Mn, Al, Ti and so on but only in slight amounts.

The rate of diffusion of Ni in the oxide film must be low. It is also required that even when the film is destroyed while the product is used, it can be immediately regenerated. For attaining such functions, the oxide film must have such structure as mentioned above and, further, the first layer mainly composed of $Cr_2O_3$ must have an adequate Cr content and adequate compactness etc.

The poor metal release preventing capacity of the oxide film of the conventional nickel-base alloys is due to the fact that the proportion of $Cr_2O_3$ in the oxide film is low, the $Cr_2O_3$ film thickness is insufficient and the $Cr_2O_3$ film is not compact.

(2) Cr content in the first layer

It is the Cr content in the oxide film of the first layer that influences the level of released Ni from the nickel-base alloy in high-temperature water environments. For reducing the level of released Ni, the Cr content in the first layer should not be lower than 50% and the film thickness and compactness should be within respective specific ranges. The higher the Cr content is, the greater the elution preventing effect is. A content of not less than 70% is desirable.

The Cr content so referred to herein means the amount of Cr expressed by mass % when the total amount of all metal components in the first layer mainly composed of $Cr_2O_3$ is taken as 100. In the present specification, such oxide film layer having a Cr content of not less than 50% in the above sense is referred to as "film mainly composed of $Cr_2O_3$".

(3) Grain size of $Cr_2O_3$ crystals in the first layer

The grain size of $Cr_2O_3$ crystals is important as an indicator of the compactness of the oxide film. When a nickel-base alloy product is used in a high-temperature water environment, Ni is released from the base metal through the $Cr_2O_3$ film. On that occasion, Ni diffuses and migrates along the grain boundary of $Cr_2O_3$. When the grain size of $Cr_2O_3$ crystals is smaller than 50 nm, the number of grain boundaries increases and, as a result, the diffusion of Ni is promoted and the release thereof is facilitated accordingly. Therefore, a lower limit of 50 nm has been placed on the crystal grain size.

Even when the $Cr_2O_3$ oxide film has been formed uniformly on the nickel-base alloy, the $Cr_2O_3$ film may be broken for various causes. Once broken, the oxide film allows release of Ni from the broken site(s) although at lower levels as compared with the case where there is no oxide film at all. Roughly classified, the following two are main causes of breakage of the $Cr_2O_3$ film. The first is the external force exerted on the product during fabrication or use. A typical example of the external force during fabrication is bending force. The external force during use is, for example, vibration. The other is the stress due to the difference in the coefficient of thermal expansion between the base metal and the oxide film.

The base metal, namely the nickel-base alloy, and the oxide film differ in the thermal expansion coefficient. Therefore, when cooling to room temperature is carried out after oxide film formation on the base metal surface at high temperatures, a compressive stress is generated in the oxide film, and a tensile stress in the base metal. When the grain size of $Cr_2O_3$ crystals exceeds 1,000 nm and thus the crystals become coarse, the strength of $Cr_2O_3$ decreases and the resistance to film breakage due to such a stress as mentioned above becomes weak.

(4) First film layer thickness and total oxide film thickness $TiO_2$, $Al_2O_3$ and $Cr_2O_3$ may possibly be used as oxide film for preventing the Ni release from the surface of a nickel-base alloy. They are all relatively low in solubility in high-temperature water and, when compact oxide films are formed, they are effective in preventing the Ni release. However, the presence of large amounts of Ti, Al and so forth in the nickel-base alloy, the amounts of intermetallic compounds and inclusions increase to exert unfavorable influences on the workability and corrosion resistance of the alloy. Therefore, according to the present invention, the oxide film mainly composed of $Cr_2O_3$ is positively formed on the surface of the nickel-base alloy product.

The Ni release from the nickel-base alloy in high-temperature water environments is influenced also by the thickness of the film mainly composed of $Cr_2O_3$. The thickness of the film mainly composed of $Cr_2O_3$, which is effective in preventing Ni release, is 170 to 1,200 nm. A thickness less than 170 nm will allow breakage of the film in a relatively short time and, then, Ni release will begin. On the other hand, a thickness exceeding 1,200 nm readily causes cracking of the film in the step of bending, for instance. Therefore, the film mainly composed of $Cr_2O_3$ adequately has a thickness of 170 to 1,200 nm.

Since the base metal and oxide film differ in thermal expansion coefficient, as mentioned above, a total oxide film thickness exceeding 1,500 nm leads to cracking of the film, hence to a tendency toward ready peeling thereof. Therefore, an upper limit of 1,500 nm is placed on the total oxide film thickness. The minimum value of the total thickness, namely the sum of the above-mentioned desirable lower limit to the thickness of the first layer and the desirable lower limit to the thickness of the second layer to be mentioned below, is thus 180 nm.

The total thickness of the oxide film means the distance (L), in FIG. 2, from the position (shown by a broken line in FIG. 2) where the relative oxygen (O) intensity becomes half the maximum value to the left end in FIG. 2. The thickness ($L_1$) obtained by subtracting the thickness ($L_2$) of the second layer from that L is the thickness of the first layer.

(5) Second layer mainly composed of $MnCr_2O_4$

The second layer is the oxide film mainly composed of $MnCr_2O_4$. The portion appearing on the left end of FIG. 2 referred to hereinabove and showing a manganese (Mn) proportion of not less than 3% is referred to as "second layer mainly composed of $MnCr_2O_4$". Therefore, the thickness of the second layer is $L_2$ shown in FIG. 2.

The $MnCr_2O_4$ layer is formed as a result of diffusion of Mn contained in the base metal toward the outer layer. When compared with Cr, Mn is lower in oxide formation free energy and is stable under a high oxygen partial pressure. Therefore, $Cr_2O_3$ is formed preferentially in the vicinity of the base metal, while $MnCr_2O_4$ is formed in the outside layer. The oxide of Mn alone is not formed since $MnCr_2O_4$ is stable in this environment and Cr is also available in a sufficient amount. Ni and Fe are also low in oxide formation energy but are slow in rate of diffusion, so that they cannot grow to give such a layer-like oxide film.

$MnCr_2O_4$ protects the $Cr_2O_3$ film in the use environment. Even when the $Cr_2O_3$ film is destroyed for some reasons, the repair of the $Cr_2O_3$ film is promoted by the occurrence of $MnCr_2O_4$. For producing such effects, it is desirable that the $MnCr_2O_4$ film has a thickness of about 10 to 200 nm.

By increasing the amount of Mn in the base metal, it is possible to cause formation of $MnCr_2O_4$ positively. However, an excessive increase in the amount of Mn adversely affects the corrosion resistance and results in an increase in production cost. Therefore, the Mn content of the base metal is desirably 0.1 to 1.0%, as mentioned above. A content of 0.20 to 0.40% is particularly desirable.

(6) Method of producing the nickel-base alloy product of the invention

The production method of the invention is characterized in that the above-mentioned oxide film excellent in the nickel release preventing capacity is formed on the surface of the nickel-base alloy product.

Such a nickel-base alloy product as a tube or sheet is produced by preparing an ingot by melting a nickel-base alloy having a predetermined chemical composition, generally followed by a process comprising hot working and annealing or a process comprising hot working, cold working and annealing. Furthermore, a special heat treatment called TT (Thermal Treatment) may be carried out so that the corrosion resistance of the base metal may be improved.

The treatment for oxide film formation in the production method of the invention may be carried out after the above-mentioned annealing or simultaneously with annealing. When the treatment is carried out simultaneously with annealing, it becomes unnecessary to add a heat treatment step for oxide film formation in addition to the conventional production process and, accordingly, the increase in production cost will be not so significant. In cases where the TT treatment is carried out after annealing, this may be carried out simultaneously with the heat treatment for oxide film formation. Furthermore, both the annealing and TT treatment may be utilized as oxide film formation treatment.

In the following, the reasons for specifying the heat treatment conditions for the oxide film formation are mentioned.

(6)-1. Atmosphere

For forming the above mentioned oxide film on the surface of the nickel-base alloy product, the atmosphere in which the heat treatment is carried out is important. The atmosphere is a hydrogen gas or hydrogen-argon mixed gas atmosphere showing a dew point within a specific range.

For forming the above oxide film compactly, moisture must be contained in the above atmosphere. The amount thereof as expressed in terms of dew point is within the range of −60° C. to +20° C. In cases where annealing is carried out in a hydrogen atmosphere containing 0 to 10% by volume of argon, the dew point is desirably within the range of −30 to +20° C. and, in cases where a hydrogen atmosphere containing 10 to 80% by volume of argon is used, it is desirably within the range of −50 to 0° C. Furthermore, it is recommendable that, where necessary or appropriate, a gas controlled in the above manner be forcedly caused to flow over the nickel-base alloy product surface where the intended film is to be formed.

(6)-2. Heat treatment temperature and time

For obtaining the necessary oxide film structure and thickness, it is necessary to control the heat treatment temperature and time. First, it is necessary to select a temperature range within which $Cr_2O_3$ is formed stably and efficiently. That temperature range is 650 to 1,200° C. At a temperatures lower than 650° C., the formation of $Cr_2O_3$ is not efficient. At a temperatures higher than 1,200° C., the formed $Cr_2O_3$ becomes no more uniform due to grain growth, hence the compactness is lost and the film is no more competent in preventing Ni release.

The heat treatment time is an important factor determining the thickness of the film. When it is shorter than 1 minute, the first oxide film layer mainly composed of $Cr_2O_3$ cannot become a uniform film having a thickness of not less than 170 nm. On the other hand, a longer period of heat treatment than 1,200 minutes, the thickness of the first oxide film layer exceeds 1,200 nm and the total oxide film thickness exceeds 1,500 nm, hence the film tends to peel off and the Ni release preventing effect of the film decreases.

It is recommendable that the product (nickel-base alloy product) to be treated be subjected to cold working prior to the above heat treatment. This is because the cold-worked surface facilitates the oxide film formation and makes the film compact. The reduction ratio in this cold working is desirably not less than 30%. Although there is no upper limit to the reduction ratio, the ratio of 90% that can be attained by the ordinary technology becomes the practical upper limit. This cold working can be carried out as a part of product working. For example, mention may be made of cold drawing or cold rolling in the production of tubes or pipes, and cold rolling of sheets.

The above TT treatment may be carried out after the heat treatment for oxide film formation. This treatment is effective in increasing the corrosion resistance, in particular the stress corrosion cracking resistance, of the nickel-base alloy product in high-temperature water. A treatment temperature of 650–750° C. and a treatment time of 300 to 1,200 minutes are appropriate. Since these treatment conditions overlap with the oxide formation treatment conditions mentioned above, it is also possible to replace the TT treatment with the oxide formation treatment.

EXAMPLES

The following examples illustrate the present invention in more detail.

Alloys having the chemical compositions shown in Table 1 were melted under vacuum, and each ingot obtained was made into plates in the following process. First, the ingot was hot-forged, then heated to 900° C. and rolled to give plates about 40 mm in thickness and 200 mm in width. They were further cold-rolled to give plates with a thickness of 26 mm and a width of 200 mm. The plates were annealed in the air at 1,080° C., the surface oxide film was mechanically removed, and some plates were used as they were and others were further cold-rolled to give plates with a thickness of 8.8 mm (reduction ratio: 35%) or 5.5 mm (reduction ratio: 78%).

TABLE 1

| | Chemical composition of test material (% by mass, balance: Ni and impurities) | | | | | | | | |
|---|---|---|---|---|---|---|---|---|---|
| Alloy | C | Si | Mn | P | S | Cr | Fe | Ti | Co |
| A | 0.015 | 0.23 | 0.25 | 0.002 | 0.001 | 29.0 | 9.5 | 0.19 | 0.01 |
| B | 0.021 | 0.25 | 0.27 | 0.003 | 0.001 | 15.9 | 8.4 | 0.20 | 0.01 |

A strip-shaped test specimen, which was 5 mm in thickness, 30 mm in width and 50 mm in length, for release test was taken from each plate by machining. The surface of the test specimen was polished to #600 by wet polishing.

The above test specimen was subjected to thermal treatment in a hydrogen or hydrogen-argon mixed gas atmosphere containing a slight added amount of steam, in lieu of the final annealing. As for the heating conditions, the temperature was varied within the range of 600–1,350° C., the heating time within the range of 0.5 minute to 25 hours (1,500 minutes), and the level of addition of moisture within the dew point range of −65 to +30° C.

The oxide film formed on the surface of each test specimen was examined by SIMS, and the thickness of the first layer (oxide film mainly composed of $Cr_2O_3$ and the thickness of the second layer (film mainly composed of $MnCr_2O_4$) were determined. Further, the test specimen was immersed in the bromine-methanol solution, and the oxide film separated was observed with FE-SEM and the grain size of $Cr_2O_3$ crystals was determined.

Some test specimens were subjected, as they were, to release test, and the levels of ion release were analyzed. The remaining test specimens were further subjected to special heat treatment [TT (Thermal Treatment)] under vacuum and then subjected to the release test. The TT treatment was carried out at temperature of 700° C. for 15 hours (900 minutes).

The release test was carried out using an autoclave, and the amount of the Ni ion released in pure water was determined. By placing the test specimen in a platinum container, the possible contamination of the test solution by ions released from the autoclave was prevented. The test temperature was 320° C., and the test specimen was immersed in pure water for 1,000 hours (60,000 minutes). After completion of the testing, the solution was immediately analyzed by Inductively Coupled Radio-frequency Plasma Desorption method (ICP), and the amount of the Ni ion release was determined.

The film formation conditions and the test results are shown in Table 2. Test Nos. 1 to 18 are examples according to the present invention. Test Nos. 19 to 22 are comparative examples. In Test Nos. 3, 5, 9, 12 and 18, the special heat treatment (TT treatment) was omitted.

The results of ICP analysis concerning the Ni ion release show that the Ni release from the test specimens prepared under the conditions according to the present invention is very slight, namely within the range of 0.01 to 0.03 ppm. On the other hand, the test specimens of the comparative examples showed release levels of 0.12 to 0.92 ppm.

TABLE 2

| Test No. | Alloy | % Reduction Ratio in Cold Working before Film Formation Treatment | Film Formation Treatment Conditions: Atmosphere | Dew Point (° C.) | Heat Temperature (° C.) | Heating Time (min) | TT Treatment (Note) | Constitution of Film: First Layer (Film mainly composed of $Cr_2O_3$) Thickness (nm) | Grain Size (nm) | Cr concen. (%) | Second Layer (Film mainly composed of $MnCr_2O_4$) Thickness (nm) | Total Film Thickness (nm) | Released Ni (ppm) | Category |
|---|---|---|---|---|---|---|---|---|---|---|---|---|---|---|
| 1 | A | 35 | $H_2$ | 10 | 1100 | 4 | Yes | 815 | 350 | 92 | 135 | 950 | 0.01 | Example of This Invention |
| 2 | B | 35 | $H_2$ | 10 | 1050 | 3 | Yes | 780 | 290 | 91 | 78 | 858 | 0.02 | |
| 3 | A | 35 | $H_2$ | 10 | 850 | 600 | No | 1235 | 120 | 65 | 215 | 1450 | 0.01 | |
| 4 | B | 35 | $H_2$ | 0 | 1090 | 5 | Yes | 780 | 280 | 91 | 110 | 890 | 0.03 | |
| 5 | A | 35 | $H_2$ | 0 | 700 | 900 | No | 1180 | 760 | 76 | 210 | 1390 | 0.01 | |
| 6 | B | 35 | $H_2$ + Ar (20 vol. %) | 10 | 1100 | 4 | Yes | 765 | 300 | 92 | 113 | 878 | 0.01 | |
| 7 | B | 35 | $H_2$ + Ar (20 vol. %) | 0 | 1050 | 3 | Yes | 683 | 280 | 88 | 81 | 764 | 0.02 | |
| 8 | B | 35 | $H_2$ + Ar (20 vol. %) | −25 | 1090 | 150 | Yes | 1230 | 890 | 68 | 150 | 1380 | 0.01 | |
| 9 | A | 35 | $H_2$ + Ar (20 vol. %) | −54 | 700 | 12 | No | 196 | 80 | 59 | 25 | 221 | 0.01 | |
| 10 | A | 35 | $H_2$ + Ar (60 vol. %) | 10 | 1100 | 4 | Yes | 794 | 315 | 96 | 111 | 905 | 0.01 | |
| 11 | B | 35 | $H_2$ + Ar (60 vol. %) | 0 | 1050 | 3 | Yes | 745 | 289 | 95 | 88 | 833 | 0.01 | |
| 12 | A | 35 | $H_2$ + Ar (60 vol. %) | −25 | 850 | 600 | No | 1190 | 580 | 73 | 242 | 1432 | 0.01 | |
| 13 | A | 0 | $H_2$ | 0 | 1100 | 4 | Yes | 945 | 330 | 85 | 75 | 1020 | 0.01 | Comparative Example |
| 14 | B | 0 | $H_2$ | 10 | 1050 | 3 | Yes | 820 | 245 | 78 | 110 | 930 | 0.02 | |
| 15 | B | 78 | $H_2$ | 10 | 1100 | 4 | Yes | 1032 | 315 | 96 | 83 | 1115 | 0.01 | |
| 16 | B | 78 | $H_2$ | 0 | 1050 | 3 | Yes | 680 | 298 | 94 | 70 | 750 | 0.01 | |
| 17 | A | 78 | $H_2$ | −25 | 1090 | 50 | Yes | 1230 | 450 | 88 | 160 | 1390 | 0.01 | |
| 18 | A | 78 | $H_2$ | −54 | 700 | 12 | No | 185 | 98 | 80 | 35 | 220 | 0.01 | |
| 19 | A | No Working | $H_2$ | 30* | 1350* | 30 | Yes | 1220 | 690* | 93 | 120 | 1340 | 0.12 | |
| 20 | B | No Working | $H_2$ | 30* | 1350* | 1500* | Yes | 1280 | 750* | 95 | 320 | 2900* | 0.31 | |
| 21 | A | | $H_2$ | −65* | 600* | 300 | Yes | 120 | 76 | 29* | 30 | 150* | 0.92 | |
| 22 | B | | $H_2$ | 20 | 1000 | 0.5* | Yes | 90 | 250 | 73 | 30 | 120* | 0.82 | |

(Note)
TT treatment Conditions: 725° C. × 600 min.
*Outside the Condition specified by the Invention.

INDUSTRIAL APPLICABILITY

The nickel-base alloy product of the present invention, even when used in a high-temperature water environment for a long period of time, allows only a very low level of Ni release. This nickel-base alloy product can easily be produced by the method of the present invention. The product of the present invention is suited for use as a structural member in an atomic energy plant, in particular.

What is claimed is:

1. A nickel-base alloy product having, on the surface thereof, an oxide film comprising at least two layers, namely a first layer mainly composed of $Cr_2O_3$ and having a chromium content of not less than 50 mass % relative to the total amount of metal elements and a second layer occurring outside the first layer and mainly composed of $MnCr_2O_4$, wherein the grain size of $Cr_2O_3$ crystals in the first layer is 50 to 1,000 nm and the total oxide film thickness is 180 to 1,500 nm.

2. A method of producing the nickel-base alloy product according to claim 1 characterized in that the method comprises subjecting a nickel-base alloy product to oxide film formation treatment by maintaining the same at a temperature of 650 to 1,200° C. in a hydrogen atmosphere or hydrogen-argon mixed atmosphere showing a dew point of −60° C. to +20° C. for 1 to 1,200 minutes.

3. A method of producing the nickel-base alloy product according to claim 1 characterized in that the method comprises subjecting a nickel-base alloy product to oxide film formation treatment by maintaining the same at a temperature of 650 to 1,200° C. in a hydrogen atmosphere or hydrogen-argon mixed atmosphere showing a dew point of −60° C. to +20° C. for 1 to 1,200 minutes and further subjecting that product to heat treatment by maintaining the same at 650 to 750° C. for 300 to 1,200 minutes.

4. A method of producing the nickel-base alloy product according to claim 1 characterized in that the method comprises subjecting a nickel-base alloy product to cold working and then to oxide film formation treatment by maintaining the same at a temperature of 650 to 1,200° C. in a hydrogen atmosphere or hydrogen-argon mixed atmosphere showing a dew point of −60° C. to +20° C. for 1 to 1,200 minutes.

5. A method of producing the nickel-base alloy product according to claim 1 characterized in that the method comprises subjecting a nickel-base alloy product to cold working and then to oxide film formation treatment by maintaining the same at a temperature of 650 to 1,200° C. in a hydrogen atmosphere or hydrogen-argon mixed atmosphere showing a dew point of −60° C. to +20° C. for 1 to 1,200 minutes and further subjecting that product to heat treatment by maintaining the same at 650 to 750° C. for 300 to 1,200 minutes.

6. A nickel-base alloy product made of a nickel-base alloy containing, in % by mass, C: 0.01–0.15%, Mn: 0.1–1.0%, Cr: 10–40%, Fe: 5–15% and Ti: 0.1–0.5%, with the balance being Ni and impurities, and having, on the surface thereof, an oxide film comprising at least two layers, namely a first layer mainly composed of $Cr_2O_3$ and having a chromium content of not less than 50 mass % relative to the total amount of metal elements and a second layer occurring outside the first layer and mainly composed of $MnCr_2O_4$, wherein the grain size of $Cr_2O_3$ crystals in the first layer is 50 to 1,000 nm and the total oxide film thickness is 180 to 1,500 nm.

7. A method of producing the nickel-base alloy product according to claim 6 characterized in that the method comprises subjecting a nickel-base alloy product to oxide film formation treatment by maintaining the same at a temperature of 650 to 1,200° C. in a hydrogen atmosphere or hydrogen-argon mixed atmosphere showing a dew point of −60° C. to +20° C. for 1 to 1,200 minutes.

8. A method of producing the nickel-base alloy product according to claim 6 Characterized in that the method comprises subjecting a nickel-base alloy product to oxide film formation treatment by maintaining the same at a temperature of 650 to 1,200° C. in a hydrogen atmosphere or hydrogen-argon mixed atmosphere showing a dew point of −60° C. to +20° C. for 1 to 1,200 minutes and further subjecting that product to heat treatment by maintaining the same at 650 to 750° C. for 300 to 1,200 minutes.

9. A method of producing the nickel-base alloy product according to claim 6 characterized in that the method comprises subjecting a nickel-base alloy product to cold working and then to oxide film formation treatment by maintaining the same at a temperature of 650 to 1,200° C. in a hydrogen atmosphere or hydrogen-argon mixed atmosphere showing a dew point of −60° C. to +20° C. for 1 to 1,200 minutes.

10. A method of producing the nickel-base alloy product according to claim 6 characterized in that the method comprises subjecting a nickel-base alloy product to cold working and then to oxide film formation treatment by maintaining the same at a temperature of 650 to 1,200° C. in a hydrogen atmosphere or hydrogen-argon mixed atmosphere showing a dew point of −60° C. to +20° C. for 1 to 1,200 minutes and further subjecting that product to heat treatment by maintaining the same at 650 to 750° C. for 300 to 1,200 minute.

* * * * *

UNITED STATES PATENT AND TRADEMARK OFFICE

CERTIFICATE OF CORRECTION

PATENT NO. : 6,482,528 B2
DATED : November 19, 2002
INVENTOR(S) : Hiroyuki Anada et al.

It is certified that error appears in the above-identified patent and that said Letters Patent is hereby corrected as shown below:

Title page,
Item [73], Assignee, is corrected as follows:

-- [73] Assignee: Sumitomo Metal Industries, Ltd.
Osaka (JP) --

Signed and Sealed this

Eighth Day of April, 2003

JAMES E. ROGAN
*Director of the United States Patent and Trademark Office*